US005955839A

United States Patent [19]

Jaffe et al.

[11] Patent Number: 5,955,839

[45] **Date of Patent: *Sep. 21, 1999**

[54] INCANDESCENT MICROCAVITY LIGHTSOURCE HAVING FILAMENT SPACED FROM REFLECTOR AT NODE OF WAVE EMITTED

[75] Inventors: Steven M. Jaffe, Palo Alto; Michieal L. Jones, Davis; Jeffrey S. Thayer, Montana; Brian L. Olmsted, Menlo Park; Hergen Eilers, Palo Alto, all of Calif.

[73] Assignee: Quantum Vision, Inc., Mountain View, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/827,189

[22] Filed: Mar. 26, 1997

[51] Int. Cl.[6] ..... H01K 1/02; H01K 1/28; H01K 1/50

[52] U.S. Cl. ..... 313/578; 313/522; 219/543

[58] Field of Search ..... 313/578, 620, 313/567, 522, 579, 580, 634, 27, 25, 37, 47, 112, 115, 636, 635

[56] References Cited

U.S. PATENT DOCUMENTS

| | | | |
|---|---|---|---|
| 4,644,141 | 2/1987 | Hagen et al. | 219/543 |
| 4,724,356 | 2/1988 | Daehler | 313/522 |
| 5,285,131 | 2/1994 | Muller et al. | 313/578 |
| 5,469,018 | 11/1995 | Jacobsen et al. . | |
| 5,475,281 | 12/1995 | Heijboer | 313/337 |
| 5,493,177 | 2/1996 | Muller et al. | 313/578 |
| 5,500,569 | 3/1996 | Blomberg et al. | 313/578 |
| 5,644,676 | 7/1997 | Blomberg et al. | 392/407 |
| 5,827,438 | 10/1998 | Blomberg et al. | 219/544 |

OTHER PUBLICATIONS

I. Hamberg and C.G. Granqvist, Evaporated Sn–doped $In_2O_3$ films: Basic optical properties and applications to energy–efficient windows, Journal of Applied Physics, vol. 60, No. 11, pp. R123–R159, Dec. 1, 1986.

Photonics Spectra, p. 40 (Jan. 1991).

H. Yokoyama, Physics and Device Applications of Optical Microcavities, 256 Science 66 Apr. 3, 1992.

*Primary Examiner*—Vip Patel
*Assistant Examiner*—Matthew J. Gerike
*Attorney, Agent, or Firm*—Fliesler, Dubb, Meyer & Lovejoy LLP

[57] ABSTRACT

An incandescent microcavity lightsource 30 has an incandescent active region 13 capable of spontaneous light emission when heated. The incandescent microcavity lightsource 30 controls the spontaneous light emissions from said active region 13.

40 Claims, 3 Drawing Sheets

INCANDESCENT MICROCAVITY LIGHTSOURCE HAVING FILAMENT SPACED FROM REFLECTOR AT NODE OF WAVE EMITTED

CROSS-REFERENCES

Cross-reference is made to U.S. Pat. No. 5,469,018, issued Nov. 21, 1995, entitled RESONANT MICROCAVITY DISPLAY, and U.S. patent application Ser. No. 08/581,622, filed Jan. 18, 1996, entitled RESONANT MICROCAVITY DISPLAY, both of which are incorporated herein by reference.

FIELD OF THE INVENTION

The present invention relates to a microcavity lightsource and method therefor.

BACKGROUND OF THE INVENTION

Incandescence is the spontaneous emission of radiation by a hot body. The emission from an idealized "blackbody" is a well understood and described in many physics texts. The output consists of a broad emission whose peak is found at a wavelength given by $\lambda=2.898\times10^6/T$ (nm/K) (see FIG. 1). As a function of wavelength, the emission is asymmetric with approximately 75% of the emission occurring on the long wavelength side of the peak. In addition, the emission is quite broad, particularly on the long wavelength side. Because of this, a blackbody must be heavily filtered at a large cost in efficiency to produce narrowband light.

A clear example of this, is the inefficiency of a blackbody in the production of visible light. If the output of a blackbody is expressed in photometric units, it is found that a temperature of 2600° K is required to obtain a luminous efficacy of 10 lumens/Watt, and a temperature of greater than 3500° K to obtain 40 lm/Watt. By comparison, an ideal narrowband source of green light would have a luminous efficacy as high as 683 lm/W, and an ideal source of white light could have a luminous efficacy of greater than 300 lm/W.

The maximum luminous efficacy for a blackbody is 95 lumen/Watt which occurs at a temperature of 6625° K. Since there are few solid materials which can operate at a temperature above 3000° K, the search for efficient sources of visible incandescence has been primarily a search for materials which can be operated at the highest possible temperatures.

The emission of real materials may be characterized by a spectral emissivity which describes its spectral radiant emittance as a fraction of that of a blackbody at the same temperature. If the emissivity were independent of wavelength, then the emission would have the same wavelength dependence as a blackbody at the same temperature. As an example, tungsten, which is the primary constituent of most visible incandescent sources, has a larger fraction of its emission in the visible than a comparable blackbody. However, at its melting point the luminous efficacy of tungsten is only 53 lm/W, and at practical operating temperatures it has a luminous efficacy in the range of 15–30 lm/W.

Clearly, a great improvement in the efficiency of incandescent lamps for many applications could be achieved if a method could be found to eliminate unwanted emission. For example, B. Hisdal in the *Journal of the Optical Society of America,* Vol. 52, Page 395, incorporated herein by reference, has calculated that a tungsten filament which has its normal emissivity for wavelengths shorter than 600 nm and an emissivity of zero for wavelengths greater than 600 nm, would give an efficacy of 407 lm/W when operated at 3000° K.

For visible lamps the most successful method developed to date for reducing the unwanted infrared emission consists of surrounding the incandescent source with a selective thermal reflector. This reflector passes visible radiation while reflecting the infrared radiation back onto the filament for reabsorption. This is the working principle of the General Electric IRPAR (Infra-Red Parabolic Aluminum Reflector) lamp (see *Photonics Spectra,* Page 40, January 1991, which is incorporated herein by reference) which is approximately one-third more efficient than a similar lamp without the reflector. Unfortunately, the practical application of this technique depends on the formation of an image of the filament which is accurately aligned onto the source. Other factors which limit the efficiency gain are the low absorption of the tungsten filament (30%–40%), and practical limits on the transparency, reflectivity and cutoff of the thermal reflector.

Incandescent sources are also characterized by highly divergent emission which is typically almost isotropic. For applications where less divergence is desired, stops, collectors and condensing optics are required. The cost of this optical system frequently exceeds the cost of the lamp which generates the light. In many cases, efficiency must be sacrificed to match the etendue of an optical system.

Optical microcavities used to control the spontaneous emission exist and are described in *Physics and Device Applications of Optical Microcavities,* H. Yokoyama, 256 Science 66 (1992), *Cavity Quantum Electrodynamics,* E. A. Hinds, in *Advances in Atomic, Molecular, and Optical Physics,* eds. D. Bates and B. Bederson, Vol. 28, pp. 237–289 (1991), and in the Jacobsen et al. U.S. Pat. No. 5,469,018, and in U.S. patent application Ser. No. 08/581,632, all of which are incorporated herein by reference. These optical microcavities have the ability to change the decay rate, the directional characteristics and the frequency characteristics of luminescence centers located within them. The study of these phenomena is entitled cavity QED (quantum electrodynamics). Physically, these microcavities have dimensions ranging from less than one wavelength of the emitted light up to tens of wavelengths. Microcavities with semiconductor active layers are being developed as semiconductor lasers and light-emitting diodes (LEDs), and microcavities with phosphor active layers are being developed for display and illumination applications. In all of these devices the efficiency is limited by the low intrinsic efficiency of the semiconductor material or phosphor which generates the light.

Incandescent sources have been formed which are contained within physical microcavities. These are described in the Muller et al. U.S. Pat. No. 5,285,131, Daehler U.S. Pat. No. 4,724,356, and Bloomberg et al. U.S. Pat. No. 5,500,569, all of which are incorporated herein by reference. However, these physical cavities are not designed as optical cavities and exhibit no modification of the spontaneous emission of the incandescent source incorporated.

SUMMARY OF THE INVENTION

Accordingly, it is an object of the present invention to provide an incandescent lightsource which emits only a selected range or ranges of wavelengths so that inefficient passive filters need not be used. These wavelengths may be infrared, visible or ultraviolet.

It is a further object of this invention to provide an incandescent lightsource which emits light only in a selected direction or directions so that expensive and inefficient passive optical elements need not be used.

It is another object of this invention to provide an incandescent lightsource which emits polarized light so that inefficient passive optical polarizers need not be used.

It is still another object of this invention to provide an incandescent lightsource of improved efficiency through the enhancement of desired emissions.

It is yet another object of this invention to provide an incandescent lightsource of improved efficiency through the suppression of undesired emissions.

It is also an object of this invention to provide an incandescent lightsource of improved efficiency through the reclamation or reabsorption of undesired emissions.

It is a further object of this invention to provide a microcavity lightsource of greater efficiency than semiconductor or phosphor based microcavity lightsources.

To this end, the subject invention, the Incandescent Microcavity Lightsource (IML), is a lightsource which uses at least one incandescent region or filament which is part of an optical microcavity.

The microcavity may be formed on a transparent or opaque substrate using standard processes of microelectronics. The filament may be wholly within the optical cavity or the surface of the filament may form one of the boundaries of the optical cavity.

The filament may emit infrared, visible, or ultraviolet light when heated. The filament may be suspended to limit thermal conduction and the cavity may be evacuated or filled with a gas to form a controlled atmosphere in order to enhance performance.

Surfaces or structures which are reflective, defining the optical microcavity, are formed adjacent to the filament. These reflectors can fundamentally suppress spontaneous emission in undesired directions, wavelengths or polarizations through the mechanisms described by cavity QED theory. Reflectors which perform this function must be located sufficiently close to the emitting surface and at the proper distance so that the individual dipolar emissions suffer destructive interference. These same, or other, reflectors can return to the filament for reabsorption, energy from undesired emissions. Any of these reflectors can form physical boundaries of the microcavity.

To generate output, these or other reflectors can enhance spontaneous emission in desired directions, wavelengths and polarizations through the mechanisms described by cavity QED theory. Reflectors which perform this function must be located sufficiently close to the emitting surface and at the proper distance so that the individual dipolar emissions undergo constructive interference. In addition, surfaces or openings can be formed which are transparent to desired emissions. Any of these can form physical boundaries of the microcavity.

Other objects and advantages of the present invention will become apparent to those skilled in the art from the following detailed description of the preferred embodiments when read in light of the accompanying drawings.

DETAILED DESCRIPTION OF THE PREFERRED EMBODIMENT

The embodiment described herein refers to an electrically heated incandescent source of directional (this direction will be referred to as upward) near-IR (1–2 $\mu$m) emission. This source exhibits suppression and reabsorption of far IR emission for all directions and reabsorption of near-IR emission into undesired directions.

Preferably, a doped polysilicon filament 10 is to be used. Filament 10 can alternatively be comprised of tungsten and of other metals such as tantalum, platinum, palladium, molybdenum, zirconium, titanium, nickel, and chromium, or a carbide, nitride, boride, silicide, or oxide of these metals. The filament is preferably operated at a temperature of approximately 1500–1600 K. In the absence of the microcavity, the filament will produce radiation which spectrally resembles a blackbody curve with a peak near 2 $\mu$m. In the absence of the microcavity, the angular distribution of the emission which escapes each surface of the filament would approximate a lambertian source (cosine theta dependence) due to the increased reabsorption for emissions parallel to the surface. In the absence of the microcavity only a small fraction, less than 10%, of the emitted energy will correspond to wavelengths in the range of 1–2 $\mu$m emitted into the upward direction (arrow 20 in FIG. 2*a*, 2*b*). Mirrors can be used to reflect emissions from other directions into the upward direction 20 but a corresponding increase in the etendue of the source would result.

Figure 1:
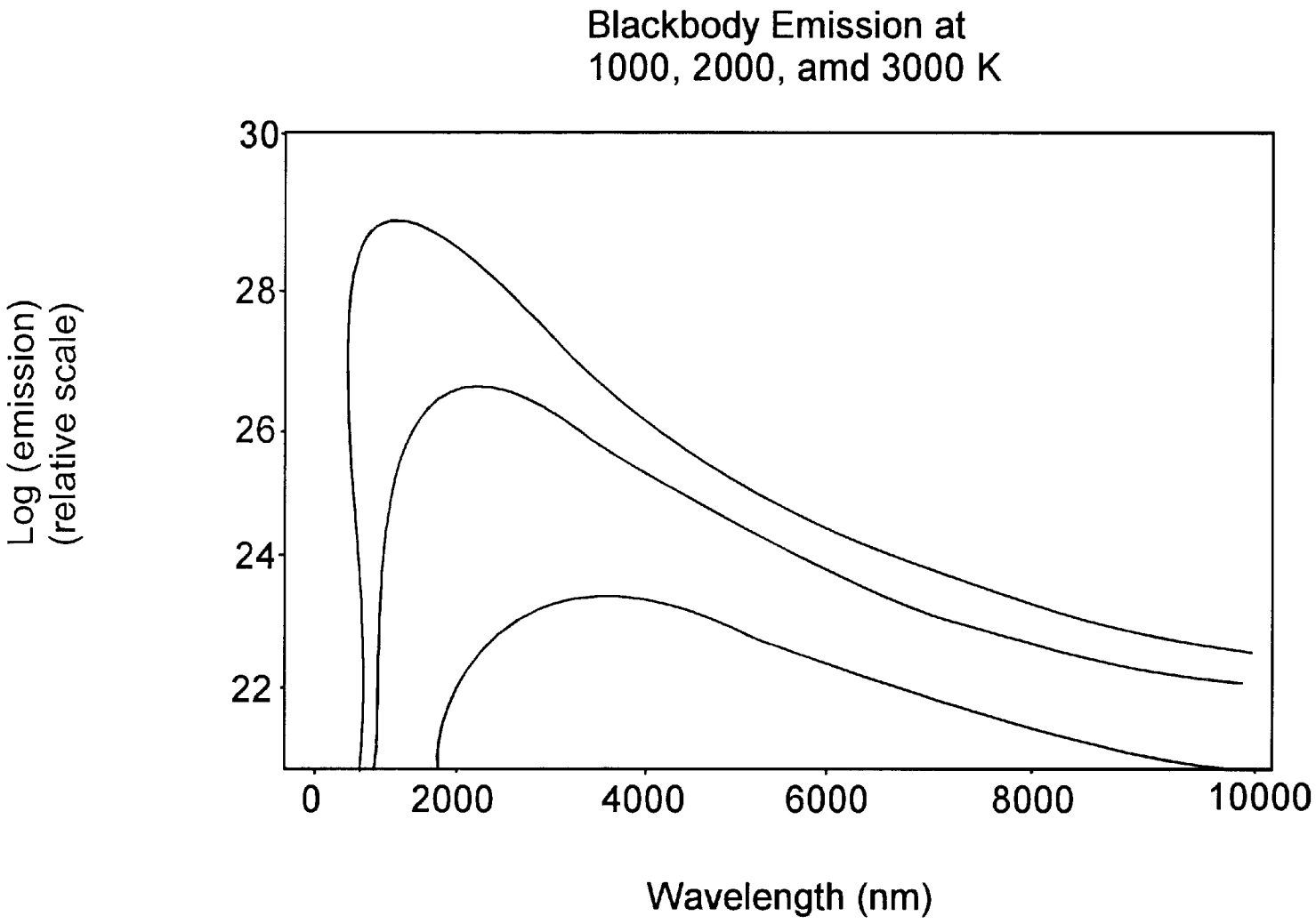
FIG. 1 depicts a graph of emission from an idealized "blackbody".
Figure 2A:
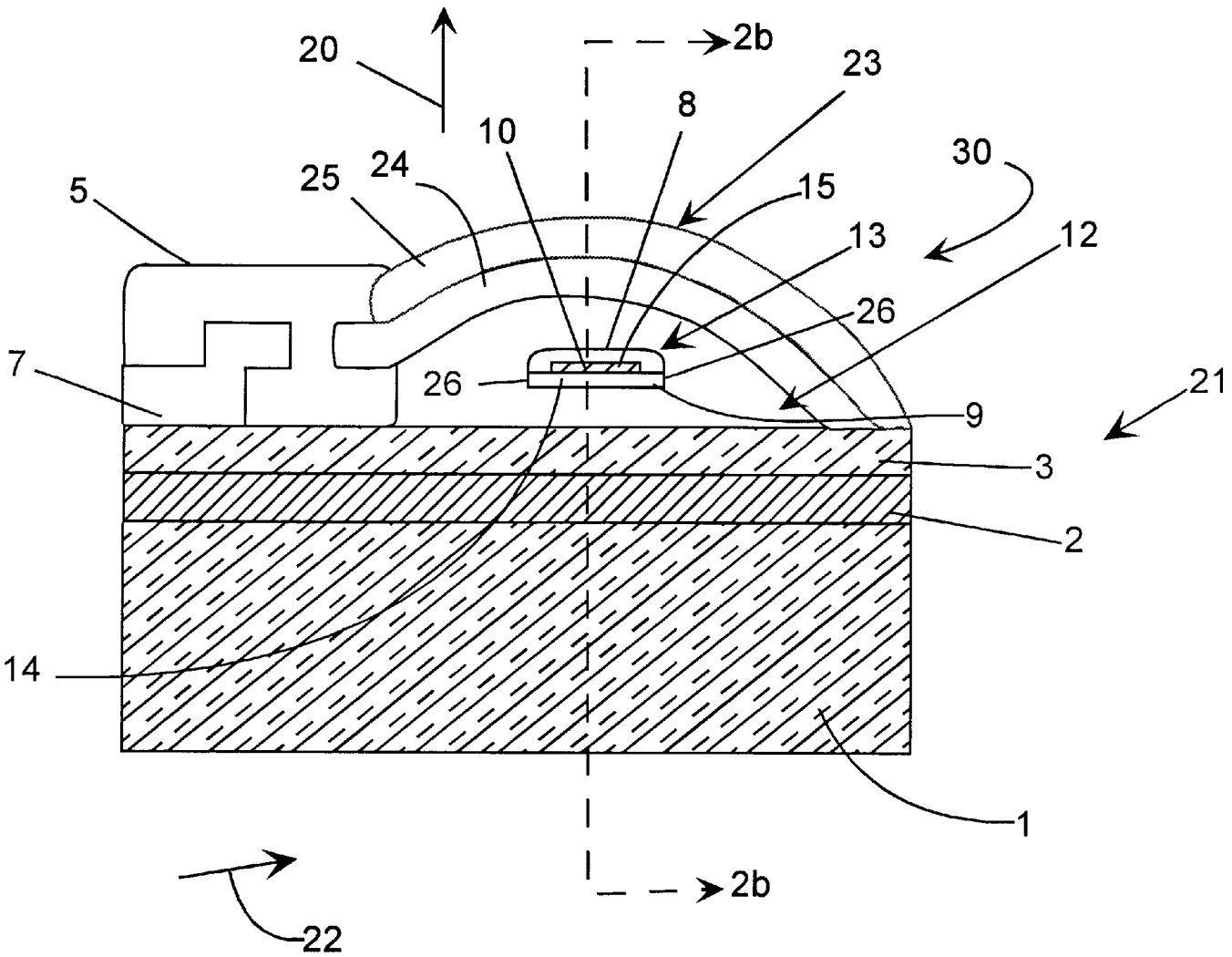
FIG. 2*a* depicts an embodiment of an incandescent microcavity of the invention.
Figure 2B:
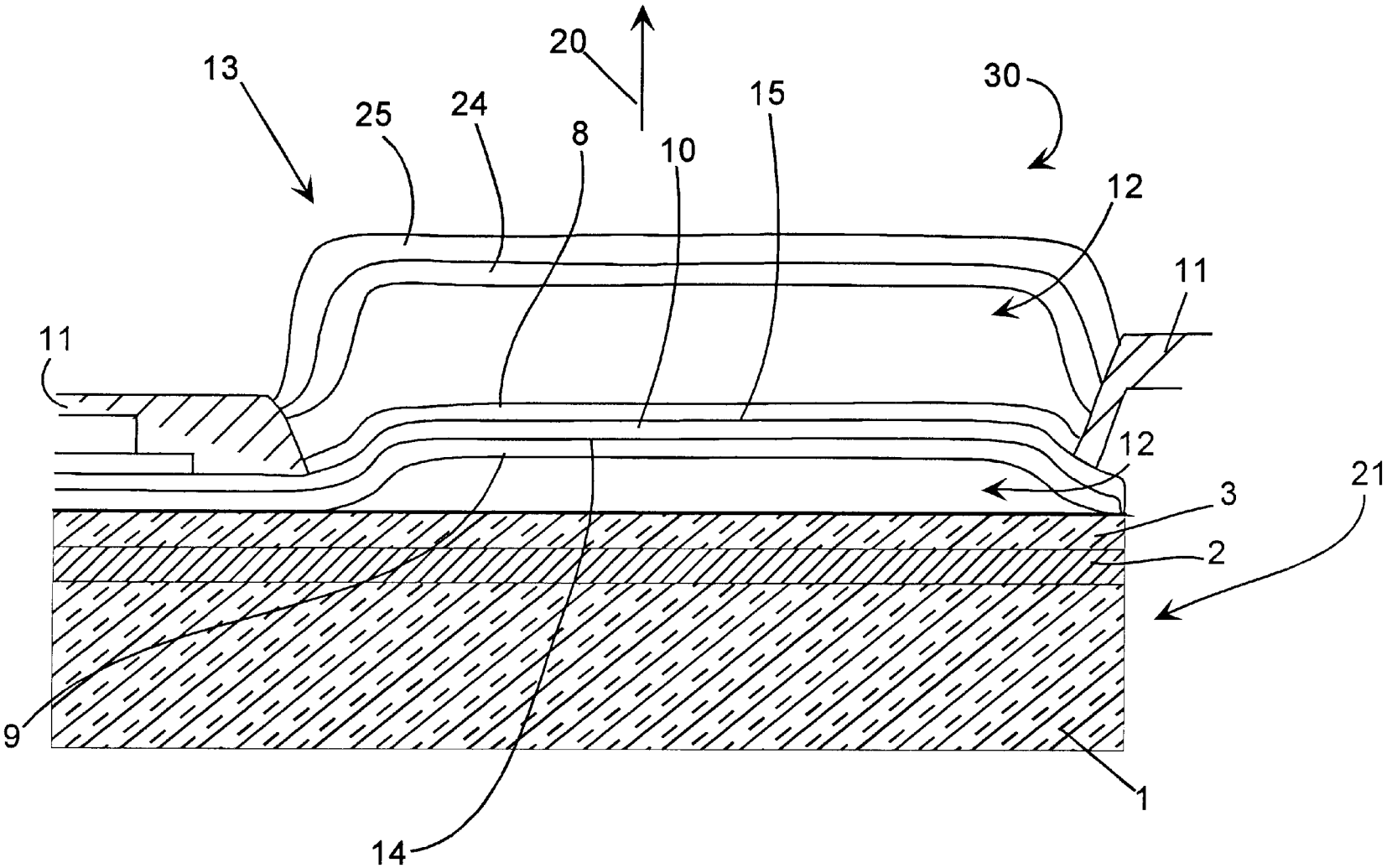
FIG. 2*b* depicts the embodiment of FIG. 2*b* taken along lines 2*b*–2*b*.

With reference to FIG. 2*a*, 2*b*, the layered structure forming the incandescent microcavity lamp 30 is shown. A silicon substrate 1, is shown. A highly reflective silver layer 2, is formed on the substrate and then a thin (approx. 100 nm or less) protective coating 3 is formed over the silver layer 2. This structure is referred to as the lower mirror 21. The lower mirror 21 as well as the upper window/mirror 23 can also be formed as taught in U.S. Pat. No. 5,469,018 with multiple layers of materials having different indexes of refraction. The protective layer 3 is formed of a material such as silicon nitride which displays resistance to etching by nitric acid. Silicon nitride is substantially transparent for wavelengths from the UV to 8 $\mu$m in the far-IR range. Other appropriate protective materials may be used.

An evacuated cavity is shown as 12. Alternatively, the cavity could include a controlled atmosphere having a desired gas or mixture of gases. This cavity 12 is formed by first depositing a sacrificial layer (not shown) such as phosphosilicate glass (PSG) of approx 0.7 micron thickness onto the protective layer 3. This sacrificial layer defines the transverse edges of the cavity 12 as shown. Onto this is grown the filament structure 13 including thin (approximately 100 nm or less) protective silicon nitride layers 8 and 9, and a doped polysilicon filament 10. The filament structure 13 may be grown using standard techniques including photolithography, plasma etching, and ion implantation. Boron, phosphorous or other dopants may be used.

Long filaments 10 which are narrow in the transverse dimension (transverse direction 22) and thin in the vertical dimension (upward direction 20) are formed. The filaments 10 need to be sufficiently long to limit heat conduction but short enough to limit sagging and touching of the lower mirror 21 when heated. If excessive sagging is indicated additional support structures (not shown) can be formed underneath the filament structure 13 through patterning of the protective layer 3 applied to the silicon layer 2 of the lower mirror 21. If excessive heat conduction is encountered, the filaments 10 can be made longer with the inclusion of supports of small cross section. Filament lengths in the range of 10–200 $\mu$m and widths of 1–10 $\mu$m are suitable.

Due to intrinsic reabsorption, light which escapes the lower surface 14 of the filament will not be isotropic, but weighted towards emissions directed perpendicular to this surface. This preferred directionality, combined with the relatively large transverse dimension (transverse direction 22) of the filament 10, will lead to reabsorption by the filament 10 of much of this light after reflection from the lower mirror 21 (silver layer 2).

These dominant emissions directed perpendicular to this lower filament surface 14 will primarily be the result of dipoles which are parallel to the plain of the filament 10. For wavelengths in the far-IR, this lower mirror 21 (silver layer 2) is closer than about one-quarter wavelength to the dipoles involved. As described in the above incorporated article of Hinds, and other literature on cavity QED, the location of this mirror 21 will lead to fundamental suppression of far-IR emissions by these dipoles. For this effect to occur, the mirror 21 must be within the appropriate coherence length for the emission so that destructive interference can result. Overall, the proper placement of the lower mirror 21 will result in a decrease in the rate of emission from the lower surface 14 of the filament and substantial reabsorption of what emissions remain. A corresponding increase in the relative emission from the upper or front surface 15 will occur.

A second sacrificial layer of PSG is over the first sacrificed layer (not shown) and encasing the filament structure 13 in order to completely define cavity 12. The thickness of this layer may be approximately 0.7 $\mu$m.

An output or upper window/mirror 23 consisting of a thin layer 24, approximately 200 nm, of protective material followed by a thicker layer 25 of indium-tin oxide (ITO), $In_2O_3$ doped with Sn, is grown on this second sacrificial layer (not shown). The protective layer 24 should be formed of a material such as silicon nitride which displays resistance to etching by nitric acid. The thicker layer 25 of indium-tin oxide (ITO) can be grown using a variety of techniques including chemical vapor deposition. This ITO layer 25 must be sufficiently thick to support atmospheric pressure if chamber 12 is evacuated. Depending on the exact shape of the structure a thickness of 2–3 $\mu$m should be adequate. Etch channels 7 and channels for electrical connections 11 must be patterned into this layer. A review of properties and techniques of growth of ITO can be found in *Evaporated Sn-doped $In_2O_3$ films: Basic Optical Properties and Applications to Energy-Efficient Windows,* I. Hamberg and C. G. Grangvist, Journal of Applied Physics, Vol. 60, No. 11, pp. R123–R159, Dec. 1, 1986, which is incorporated herein by reference.

Silicon nitride is substantially transparent for wavelengths from the UV to 8 $\mu$m in the far-IR. In this embodiment the ITO should be adequately doped to produce a reflectivity of greater than 80% for wavelengths longer than approximately 4 $\mu$m and more than 80% transmitting for wavelengths shorter than approximately 2 $\mu$m.

Due to intrinsic reabsorption, light which escapes the upper surface 15 of the filament 10 will be weighted towards emissions directed upward (direction 20). This preferred directionality, combined with the relatively large transverse dimension (direction 22) of the filament 10 will lead to reabsorption by the filament 10 of much of the far-IR emission after reflection from upper window/mirror 23.

For wavelengths in the far-IR this upper window/mirror 23 is closer than one-quarter wavelength to the dipoles involved. This will lead to fundamental suppression of far-IR emissions by these dipoles. For this effect to occur the mirror 23 must be within the appropriate coherence length for the emission so that destructive interference can occur. With reference to the desired emission wavelengths, 1–2 ||m, the upper window/mirror 23 is substantially transparent allowing these emissions to pass upwardly through window/mirror 23 of the lamp.

Overall, the upper window/mirror 23 will result in a decrease in the rate of emission of far-IR radiation from the upper surface is of the filament 10 and substantial reabsorption of what far-IR emissions remain. A corresponding increase in the fractional near-IR emission from the upper surface 15 will occur.

Because the vertical dimension (direction 20) of the filament 10 is substantially less than the other dimensions only a small fraction of the total emission will escape the side surfaces of the filament. Emissions from the sides 26 of the filament 10 will to some degree be reflected by the cavity mirrors 21, 23, and reabsorbed by the filament 10. A corresponding increase in the fractional emission from the upper surface 15 will occur.

Overall, the proper placement of the lower and upper mirrors 21, 23, will result in a relative increase in the fractional emission of near-IR light from the upper surface 15 of the filament 10.

Once the upper window/mirror 23 is formed, the sacrificial layers of PSG are removed by etching with nitric acid. Following the nitric acid etch, the lamp is placed into a vacuum system and evacuated or a controlled atmosphere including one or more gases is introduced. The etch channels 7, are sealed with an appropriate material 5, such as the protective material used earlier. Finally, metal pads 11 are grown to allow electrical connection to the filament (FIG. 2*b*).

The use of a vacuum limits heat conduction to the walls of the cavity 12. However, the lamp 30 can be attached to a heat sink (not shown) to cool the walls, if required.

In other embodiments the substrate 1 may consist of another opaque substrate material possibly a metal or a transparent material such as alumina, sapphire, quartz or glass.

Materials to be used as mirrors or windows 21, 23, can consist of metals, transparent dielectrics, or materials such as indium-tin oxide which are substantially reflective at some wavelengths and substantially transparent at other wavelengths. In addition multilayer stacks consisting of metals, materials such as ITO, and dielectrics in combination may be used. These layers can be reflective at all wavelengths concerned forming a mirror or may be transparent at some or all wavelengths forming an output window. Combination mirror/windows which consist of reflective material with holes of an appropriate size to allow shorter wavelengths to pass can also be used. Appropriate layers to protect these mirrors and windows from later etching stages can be formed as required.

In other embodiments the distance between mirrors 21, 23, and the filament 10 may be selected to suppress undesired wavelengths other than the far-IR. However, difficulties with surface plasmon production and direct energy transfer to these mirrors can occur in certain cases (see E. A. Hinds identified above). Distances less than a quarter of a wavelength and generally less than a tenth of a wavelength can cause such conductive energy transfer to the mirrors with a loss of radiated energy from the lamp 30. In these cases, the materials and distances involved along with the shapes of the surfaces are adjusted accordingly.

In other embodiments the distance between one or both of the mirrors 21, 23, and the filament 10 may be selected to enhance desired emissions through constructive interference. By way of example, the embodiment can have one or more spaced upper window/mirror and one or more lower window/mirrors. These mirrors can be positioned relative to the filament in order to enhance and/or suppress certain emissions. Placement of mirrors such that antinodes are produced at the surface of the filament can enhance emission while placement of mirrors such that nodes are produced at the surface of the filament can suppress emissions.

In other embodiments the output window/mirror 23 can be selected to pass wavelengths other than the near-IR. Windows can be formed which allow emission from any single or multiple direction. Windows can be formed which exhibit birefringence resulting in a partially or substantially polarized output. Windows can be formed which allow the emission of different polarizations and/or wavelengths into different directions.

In still other embodiments the filament 10 may consist of a high temperature refractory material. High temperature refractory materials suitable for incandescent lamps 30 are well known in the literature. Tables of suitable materials are presented in *The Chemistry of Artificial Lighting Devices,* R. C. Ropp (Elsevier, Amsterdam, 1993), which is incorporated herein by reference. Appropriate layers to protect the filament from later etching stages may be formed if required. Sacrificial layers of materials other than PSG may be formed for use with etchants other than nitric acid.

In other embodiments, an electrically heated getter material can be added to the cavity to aid in maintenance of the vacuum once the cavity is sealed. The use of getters is well known in vacuum science.

In other embodiments the output window may consist merely of an open upper surface with the filament operated in air or other ambient media.

Industrial Applicability

From the above, it is evident that incandescent light sources can be formed that are more efficient than those currently existing and that are specifically designed for particular needs.

Other features, aspects and objects of the invention can be obtained from a review of the figures and the claims.

It is to be understood that other embodiments of the invention can be developed and fall within the spirit and scope of the invention and claims.

We claim:

1. A device comprising:

an optical microcavity with an incandescent active region;

said incandescent active region having an incandescent light source disposed therein for emitting light;

said incandescent active region capable of having spontaneous light emission when heated; and said optical microcavity including means for controlling the spontaneous light emission from said active region.

2. The device of claim 1, wherein the control of spontaneous light emission is achieved by the controlling means by decreasing the rate of certain emission.

3. The device of claim 1, wherein the control of spontaneous light emission is achieved by the controlling means by increasing the rate of certain emission.

4. The device of claim 1, wherein the control of spontaneous light emission is achieved by the controlling means by causing the reabsorption of energy.

5. The device of claim 1 wherein:

the controlling means include at least one mirror for controlling the spontaneous light emission from said active region.

6. The device of claim 1 wherein:

said controlling means include a lower mirror and an upper window/mirror; and wherein said lower mirror reflects light back into said cavity, and said upper window/mirror reflects some light back into said cavity and allows some light to pass outwardly of said cavity.

7. The device of claim 1 including:

said incandescent active region includes an incandescent filament.

8. The device of claim 7 wherein:

said filament includes a polysilicon filament.

9. The device of claim 7 wherein:

said filament is selected from the group consisting of tungsten, tantalum, platinum, palladium, molybdenum, zirconium, titanium, nickel, and chromium or a carbide, nitride, boride, silicide, or oxide of these metals.

10. The device of claim 7 wherein:

said incandescent filament is comprised of a high temperature refractory material.

11. The device of claim 1 wherein:

the incandescent active region is capable of emitting wavelengths in at least one of an infrared range, a visible range, and an ultraviolet range.

12. The device of claim 1, wherein the control of spontaneous emission is achieved by the means for controlling by controlling the direction of such emission.

13. The device of claim 1, wherein the control of spontaneous emission is achieved by the means for controlling by controlling the wavelength of such emission.

14. The device of claim 1, wherein the control of spontaneous emission is achieved by the means for controlling by controlling emission polarizations.

15. The device of claim 1 wherein said optical microcavity is a multi-dimensional cavity.

16. A device comprising:

a resonant optical microcavity with an incandescent active region;

means for controlling spontaneous light emission from the incandescent active region; and said active region having a source of incandescent light.

17. The device of claim 16 wherein:

said means for controlling can accomplish at least one of (1) increasing the rate of light emission; (2) decreasing the rate of light emission; and (3) causing reabsorption of energy by the incandescent lightsource in the active region.

18. The device of claim 16 wherein:

said means for controlling has at least one mirror that can control spontaneous light emission from said active region.

19. The device of claim 16 wherein:

said means for controlling include a lower mirror and an upper window/mirror; and wherein said lower mirror reflects light back into said resonant optical microcavity, and said upper window/mirror reflects some light back into said resonant optical microcavity and allows some light to pass outwardly of said resonant optical microcavity.

20. The device of claim 16 wherein:

said incandescent lightsource can emit wavelengths in at least one of the infrared range, the visible range, and the ultraviolet range.

21. The device of claim 16 wherein:

said means for controlling can improve the efficiency of incandescent light emission through at least one of enhancement, suppression, and reabsorption of energy from the resonant optical microcavity.

22. The device of claim 16 wherein:

said incandescent active region includes an incandescent filament.

23. The device of claim 22 wherein:

said filament can be at least one of (1) suspended in said microcavity, and (2) form a boundary of said microcavity.

24. The device of claim 16 wherein:

said source of incandescent light is generated by an electrically heated filament.

25. The device of claim 16 wherein:

said controlling means includes a mirror which is positioned such that at least one of a node and an antinode of a standing wave are produced relative to the incandescent active region.

26. The device of claim 16 wherein:

said resonant optical microcavity is on of (1) evacuated or (2) filled with one or more gasses to create a controlled atmosphere.

27. The device of claim 16 wherein:

said means for controlling has a mirror which can pass some emission from said incandescent active region and which can reflect some emissions from said incandescent active region.

28. The device of claim 16 wherein:

said means for controlling includes a window which can pass emission from said incandescent active region.

29. A method of enhancing the output of a incandescent light source comprising the steps of:

providing an incandescent light source capable of having spontaneous light emission; and providing means for controlling the spontaneous light emission from said incandescent light source in a resonant optical microcavity.

30. The method of claim 29 wherein said second providing step includes:

controlling the spontaneous light emission by at least one of (1) decreasing the rate of certain emissions, (2) increasing the rate of certain emissions, and (3) causing the reabsorption of energy.

31. An incandescent light source device comprising:

an optical microcavity with an incandescent active region;

said active region having an incandescent light source disposed therein for emitting light;

said incandescent active region has spontaneous light emission when heated; and said optical microcavity controls the spontaneous light emission from said active region.

32. An incandescent light source device comprising:

an optical microcavity with an active region; and said active region having an incandescent light source disposed therein for emitting light.

33. The incandescent light source device of claim 32 wherein said microcavity comprises:

a substrate;

a lower reflective region disposed upon said substrate;

said active region disposed upon said lower reflective region; and an upper reflective region disposed upon said active region; and at least one of said lower and said upper reflective regions is partially reflective, so that light produced by excitation of said active region forms a standing wave between said lower reflective region and said upper reflective region and is emitted through said at least one partially reflective region.

34. The incandescent light source device of claim 33 wherein said lower reflective region is a metallic reflector.

35. The incandescent light source device of claim 33 wherein said upper reflective region is a metallic reflector.

36. The incandescent light source device of claim 33 wherein said active region includes one of a doped polysilicon filament, a tungsten filament, and a tungsten alloy filament.

37. The incandescent light source device of claim 33, wherein said lower reflective region and upper reflective region are dielectric reflectors.

38. The incandescent light source device of claim 37 wherein said dielectric reflectors comprise a plurality of alternating parallel layers wherein a first layer of said layers comprises a material with a relatively low index of refraction and a second of said layers comprises a material with a relatively high index of refraction.

39. The incandescent light source device of claim 38 wherein said material with a relatively low index of refraction is selected from fluorides and oxides.

40. The incandescent light source device of claim 38 wherein said material with a relatively high index of refraction is selected from sulfides, selenides, nitrides and oxides.

* * * * *